US005295728A

United States Patent [19]

Schaevitz

[11] Patent Number: 5,295,728

[45] Date of Patent: Mar. 22, 1994

[54] ERGONOMIC MULTI-POSITION WORK STAND

[76] Inventor: Lester P. Schaevitz, 431 North Latch's La., Merion Station, Pa. 19066

[21] Appl. No.: 468,596

[22] Filed: Jan. 23, 1990

[51] Int. Cl.[5] ..... B60N 2/38

[52] U.S. Cl. ..... 297/195.1; 297/423.24; 297/423.12

[58] Field of Search ..... 297/195, 464, 118, 409, 297/410, 391, 411, 423

[56] References Cited

U.S. PATENT DOCUMENTS

| | | | |
|---|---|---|---|
| 3,477,673 | 11/1969 | Bereday | 297/195 X |
| 3,754,787 | 8/1973 | Garber | 297/195 X |
| 4,108,462 | 8/1978 | Martin | 297/195 X |
| 4,589,699 | 5/1986 | Duncan | 297/423 |
| 4,662,361 | 5/1987 | Patterson | 297/195 X |
| 4,793,655 | 12/1988 | Kvalheim | 297/195 X |
| 4,863,178 | 9/1989 | Friesen | 297/195 X |

*Primary Examiner*—Jose V. Chen
*Attorney, Agent, or Firm*—Robert Charles Beam

[57] ABSTRACT

An ergonomic, multi-position work stand is disclosed in which a base member provides support and stability for a user and dissipates the forces placed on the work stand by a user. The work stand also comprises at least one vertical support member capable of securely attaching to the base member and transferring the forces placed on the work stand by a user. In addition, the work stand further comprises an upper body support member adjustably attached to the vertical support member which may be an adjustable padded support. The padded support may be adjusted in vertical height, horizontal placement and radial tilt for the comfort and convenience of a user.

In another embodiment the work stand is also provided with a seat capable of supporting at least a portion of the weight of a user.

13 Claims, 6 Drawing Sheets

ERGONOMIC MULTI-POSITION WORK STAND

FIELD OF THE INVENTION

The present invention relates to an ergonomic, multi-position work stand.

DESCRIPTION OF THE PRIOR ART

In various industrial applications, workers are required to remain in one location, either sitting or standing, and work on a continuing stream of required tasks. This might occur on a factory assembly line, in a food-processing industry or even a clerical function, such as a mail room or the like.

For many years a worker in such a position would have been expected to stand, but sitting in a fixed position has become common. The seats provided to such workers, however, are typically no more than institutional office seating, and often do not provide adequate support or comfort to a worker.

Neither a standing nor a sitting position is particularly comfortable or supportive unless the worker is provided with satisfactory support which can be adjusted to the needs and comfort of the user.

Such a support is particularly useful where the user must lean toward the work to be performed, and few, if any, devices are available to accomplish such tasks. Stationery stands are available which allow a user to lean in a standing position, but the known devices do not provide adequate back support, permit relocation of the device to another position, or permit realignment to accommodate a variety of differing positions.

SUMMARY OF THE INVENTION

It is an object of the present invention to provide a work stand which will provide for the comfort, stability and support of a user during the completion of required tasks.

It is a further object of the present invention to provide a work stand which will realign to accommodate differing working positions.

It is a still further object of the present invention to provide a work stand which can be conveniently relocated to another position.

The other objects, features and advantages of the present invention will become more apparent in light of the following detailed description of the preferred embodiments thereof.

According to one embodiment of the present invention, there is provided an ergonomic, multi-position work stand comprising:

a base member providing support and stability for a user and dissipating the forces placed on said work stand by a user;

at least one vertical support member capable of securely attaching to said base member and transferring the forces placed on said work stand by a user; and, an upper body support member adjustably attached to said at least one vertical support member and comprising a padded support provided with means to adjust said padded support in vertical height, horizontal placement and radial tilt for the comfort and convenience of a user, said upper body support member being capable of receiving the forces placed on said work stand by a user and transferring said forces through said at least one vertical support member to said base member.

According to another embodiment of the present invention there is provided an ergonomic, multi-position work stand comprising:

a base member providing support and stability for a user and dissipating the forces placed on said work stand by a user;

at least one vertical support member capable of securely attaching to said base member and transferring the forces placed on said work stand by a user;

an upper body support member adjustably attached to said at least one vertical support member and comprising a padded support provided with means to adjust said padded support in vertical height, horizontal placement and radial tilt for the comfort and convenience of a user, said upper body support member being capable of receiving the forces placed on said work stand by a user and transferring said forces through said at least one vertical support member to said base member; and a seat member capable of supporting at least a portion of the weight of a user, said seat member being adjustably mounted along the height of said at least one vertical support member to provide for height adjustment to said seating member, and reversible in orientation.

DETAILED DESCRIPTION OF THE INVENTION

Figure 1:
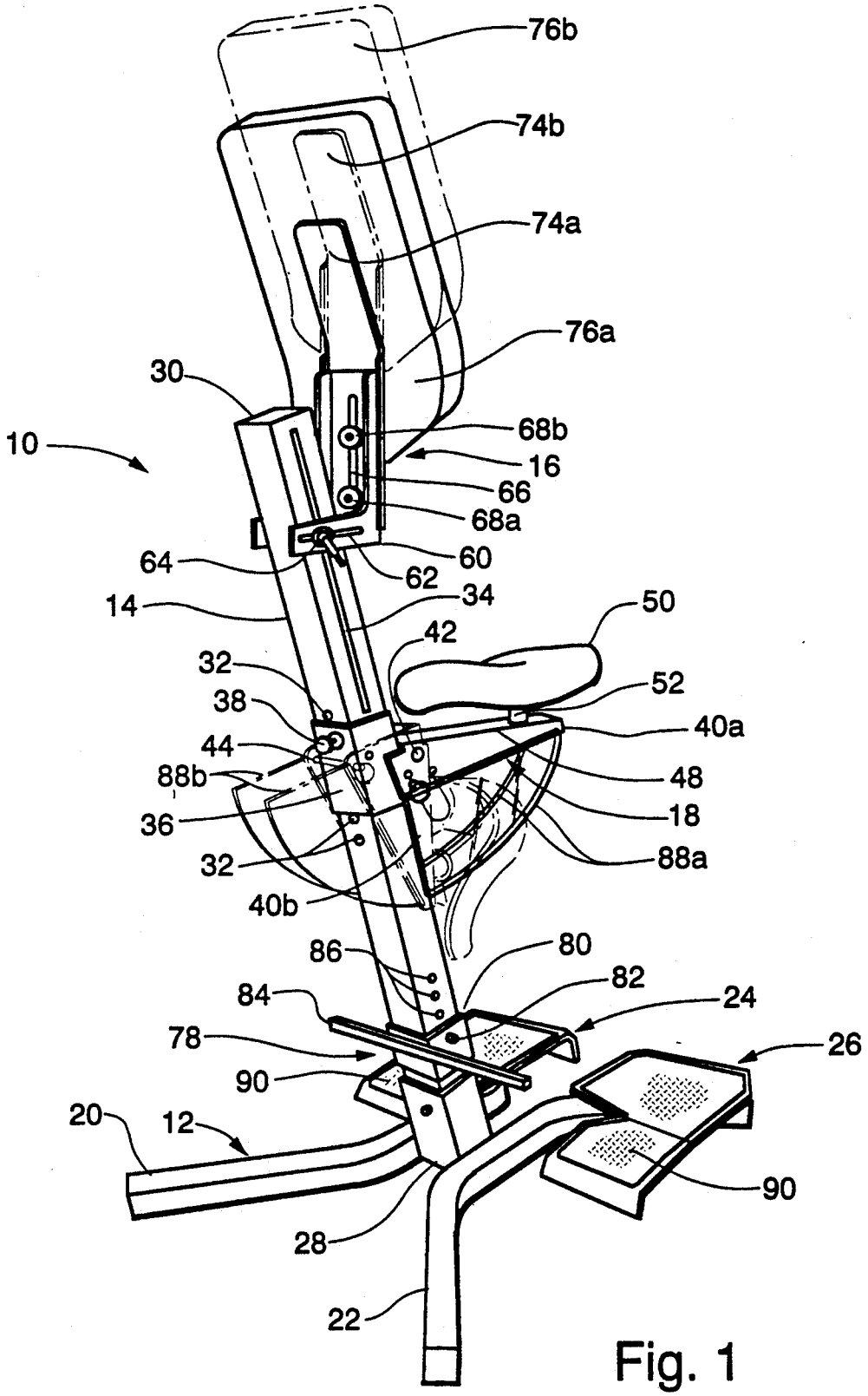
FIG. 1 shows the preferred embodiment of the device of the present invention.

The preferred embodiment of the present invention is shown in FIG. 1. In the illustrated embodiment, the ergonomic, multipurpose work stand of the present invention is shown generally as 10, comprising base member 12, vertical support member 14, upper body support member 16 and seat member is 18.

The base member 12 may have any number of suitable geometries so long as the primary function, dissipating the forces placed on the work stand 10 by a user, is met. In the illustrated embodiment, the base member 12 is comprised of leg members 20 and 22. These leg members, 20 and 22, spread in a horizontal plane and are designed to support a user employing the work stand 10 and dissipate the forces placed on the work stand 10 by a user.

In addition, the work stand 10 of the preferred embodiment is further provided with footpads 24 and 26 which are preferably fixedly attached to some position on the base member 12, such as the leg members 20 and 22, as shown.

Another feature of the preferred embodiment are the tractive surface facings 90 on the footpads 24 and 26.

Also illustrated in FIG. 1 is base member support 28, a central support means to which the leg members 20 and 22 are fixedly attached, and which defines a cavity to surround and support the vertical support member 14.

One skilled in the art would recognize that various other geometries could be employed to provide a suitable base member 12. Further, base member 12 could be provided by a member securely affixed to the work surface, as known to the prior art, although some objects of the present invention would not be obtained thereby.

The vertical support member 14 of the present invention is shown as a single vertical column 30 in the preferred embodiment, although a plurality of such vertical columns could also be provided. The vertical column 30 illustrated is further provided with several seat member detentes, such as 32 for the positioning of seat member 18, at various heights along the vertical support member 14. In the illustrated embodiment, the vertical support member 14 is of tubular construction.

The vertical support member 14 of the present invention further includes provision for the attachment of upper body support 16 to the vertical support member 14, illustrated as the elongated slot 34 cut through the sides of vertical support member 14.

Seat Member 18 as shown in FIG. 1 in both its raised and lowered positions and as described in the present discussion of the primary embodiment is further comprised of several components. Seat sleeve 36 surrounds vertical support member 14 and can be locked into a vertical position along the length of vertical support member 14 by engaging seat height locking pin 38 with one of the several seat member detentes 32 located on the vertical support member 14.

Figure 1A:
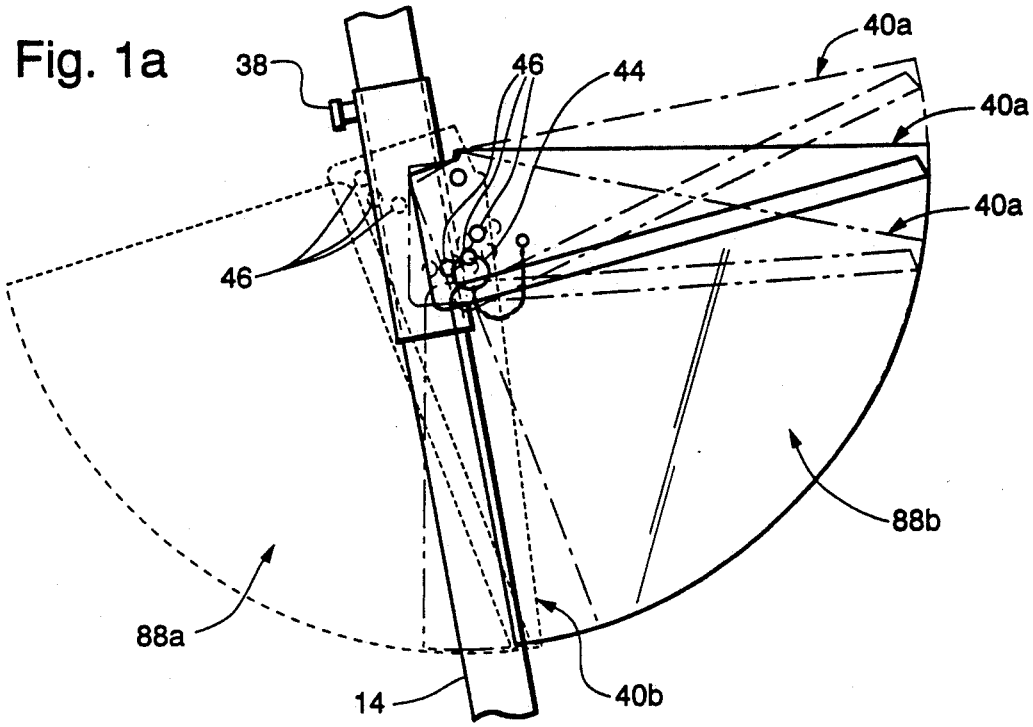
FIG. 1*a* detail of the adjustment of the seat bracket of the present invention.
Figure 1B:
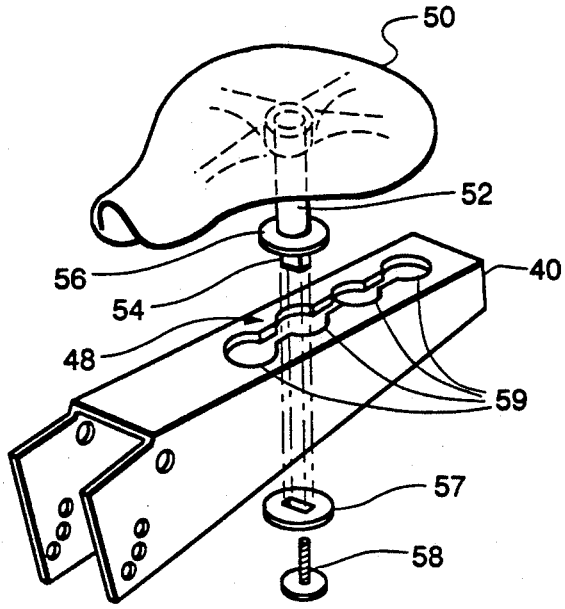
FIG. 1*b* shows detail of the adjustment of the seat of the present invention.
Figure 1C:
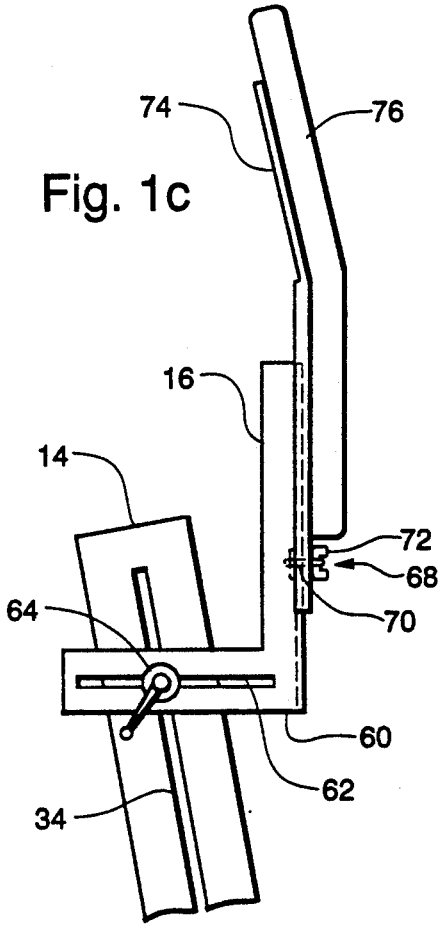
FIG. 1*c* shows detail of the adjustment of the upper body support member of the present invention.

Seat Bracket 40, shown in its raised position as **40*a* and its lowered position as 40*b* in FIG. 1, is pivotally attached to seat sleeve 36 by pivot pin 42. The positions of seat bracket 40 relative to seat sleeve 36 and, therefore, relative to vertical support member 14, are shown more clearly in FIG. 1*a*. As shown in FIG. 1*a*, the seat bracket may be in one of several raised positions 40*a*, or its lowered position 40*b* and locked in its position by engaging seat angle locking pin 44 with one of the seat locking detentes 46**.

Also shown in the preferred embodiment as illustrated in FIG. 1, and detailed more clearly in FIG. **1*a*, are the shear guards 88 which may extend downward from the seat bracket 40. Thus, the shear guards 88 as illustrated as 88*a* depending from the seat bracket 40*a* in its raised position, and as 88*b* depending from the seat bracket 40*b* in its lowered position. The purpose of the shear guards is a safety feature, to prevent injury caused by catching a finger or the like between seat bracket 40 and the vertical support member 14** during adjustment.

The seat bracket is also provided with an elongated slot 48 through the top surface thereof. This elongated slot 48 permits the attachment of rotatable seat 50 by means of post 52 which may be fixedly engaged to seat bracket **40*a*. This assembly of elongated slot 48 and post 52 permits seat 50 to be located nearer or further from the vertical support member 14**, according to the comfort of a user.

The details by which the seat 50 may be operatively mounted are shown more clearly in FIG. **1*b*. As seen in an exploded view therein, seat 50 is mounted upon seat post 52, which terminates in semi-rectangular stud 54, which extends through washer 56 and elongated slot 45 of seat bracket 40, and engages washer 57 and threaded bolt 55. Elongated slot 45 is further shown to be provided with a plurality of circular nodes 59, wherein the semi-rectangular stud is free to turn, allowing the seat 50 to rotate freely at set positions along the elongated slot 48. Assembled in this manner, threaded bolt 58 need not be disengaged to allow the seat 50 to be turned and re-orientated or moved to a more comfortable distance from the vertical support member 14**.

With continued reference to FIG. 1, the vertical support member 14 is further provided with an upper body support member 16, as noted previously. This upper body support member 16 is further comprised of an upper body support bracket 60, provided with an elongated horizontal attachment slot 62 through the sides thereof allowing attachment to the vertical support member 14 by means of vertical support attachment means 64. In the preferred embodiment, vertical support attachment means 64 is formed by a clamping mechanism having radial grooves. Assembly in this manner allows the height of the upper body support 16 to be adjusted by selection of a position of the vertical support attachment means 64 along the length of the elongated slot 34. Forward/rearward position adjustment of the upper body support 16 may be obtained by selection of a position of the vertical support attachment means 64 along the length of the horizontal attachment slot 62. Finally, the angle, or radial position, of the upper body ,support 16 can be adjusted by proper selection of the radial grooves in the clamping mechanism of vertical support attachment means 64. In this manner, the position and adjustment of the upper body support 16, may be set as desired.

Upper body support bracket 60 is further provided with an elongated upper body support attachment slot 66, permitting attachment of an upper body attachment bracket 74, shown adjusted to a lower position as **74*a*, and adjusted to a raised position as 74*b*. Upper body support attachment bracket 74 is engagedly mounted to upper body support bracket 60 by means of upper body support attachment means 68. Fixedly attached to upper body support attachment bracket 74 is upper body support pad 76, shown adjusted to a lower position as 76*a*, and adjusted to a raised position as 76*b***.

This assembly is shown more clearly in FIG. **1*c*, wherein upper body support bracket 60 is adjustably engaged to vertical support member 14 by means of vertical support attachment means 64 passing through elongated slot 34 in vertical support member 14 and horizontal attachment slot 62 in upper body support bracket 60. Upper body support attachment bracket 74, with upper body support pad 76 attached thereto, is adjustably attached to upper body support bracket 60 by upper body support attachment means 68, comprising upper body support attachment means bolt 70 and upper body support attachment means nut 72**. Other components, such as washers and the like may also be employed in accomplishing the attachment.

In this manner, the upper body support member may be operatively adjusted for the comfort and support of a user. This may be accomplished by first partially disengaging the vertical support attachment means 64, and positioning the vertical height of upper body support bracket 60 along elongated slot 34. Then, the desired distance from the vertical support member 14 may be adjusted along the vertical support attachment slot 62 and the angle at which the upper body support bracket 60 and the vertical support member meet. When each of these adjustments are satisfactory, The vertical support attachment means may be re-tightened to hold the upper body support 16 in the desired position.

Further adjustment may be made by partially disengaging the upper body support attachment means 68, raising or lowering the upper body support attachment bracket 74 and the upper body support pad 76 to a desired position along upper body support attachment slot 66, and re-tightening the upper body support attachment means 65.

Also illustrated in FIG. 1, is auxiliary footrest 78, comprising footrest sleeve so, footrest locking pin 82, and footrest bar 54. In the preferred embodiment, auxiliary footrest 78 may be positioned vertically along vertical support member 14 by engaging footrest locking pin 82 with one of several footrest detentes 86 provided along vertical support member 14. This auxiliary footrest 78 is not necessary to all position adjustments of the present invention as will be seen more clearly hereinafter.

Figure 2:
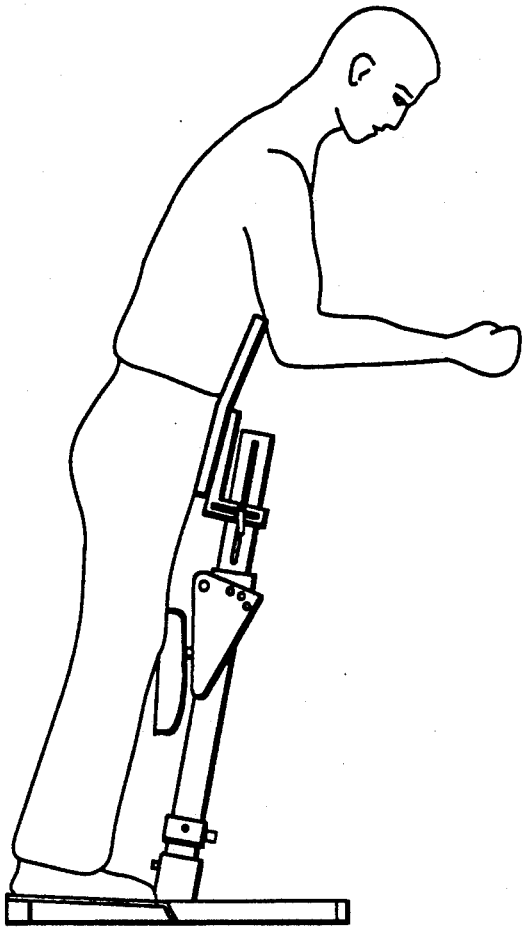
FIG. 2 shows the device of the present invention as it would be employed by a standing user in one orientation.

FIG. 2 shows the device of the present invention as it would be employed by a standing user in one orientation, to perform some useful work in that position.

Figure 3:
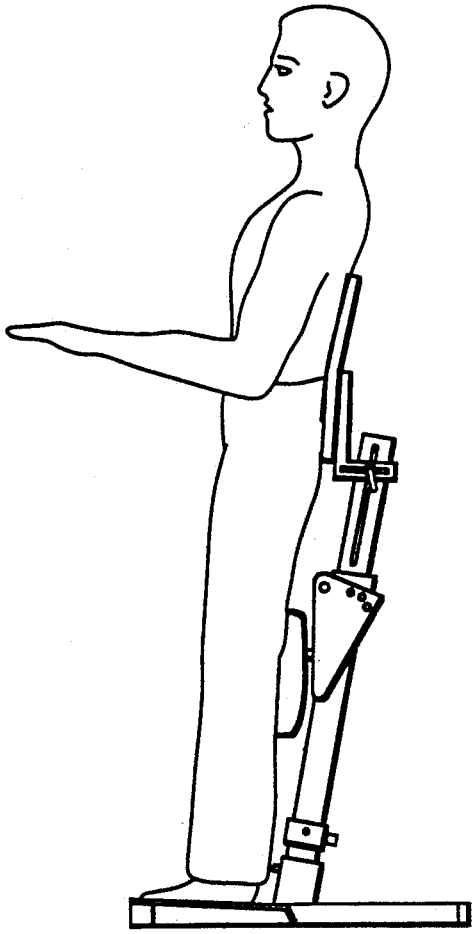
FIG. 3 shows the device of the present invention as it would be employed by a standing user in an orientation opposite to that of FIG. 2.

FIG. 3 shows the device of the present invention as it would be employed by a standing user in an orientation opposite to that of FIG. 2.

Figure 4:
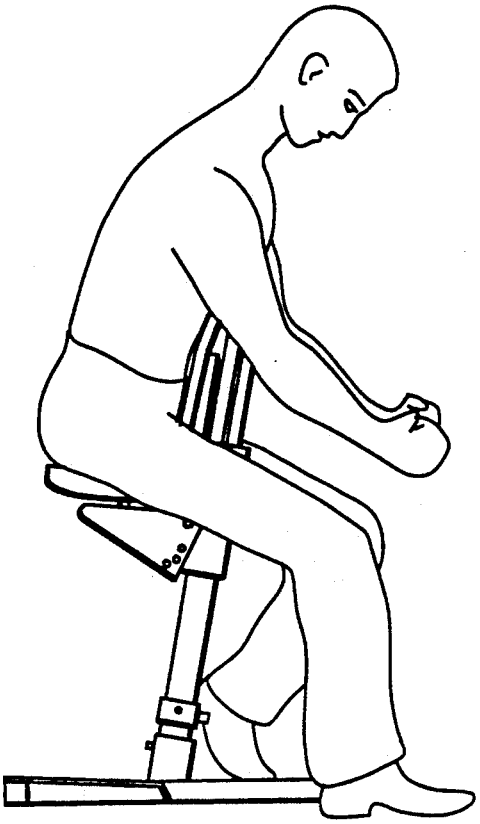
FIG. 4 shows the device of the present invention as it would be employed by a sitting user in one orientation.

FIG. 4 shows the device of the present invention as it would be employed by a sitting user in one orientation, to perform some useful work in that position.

Figure 5:
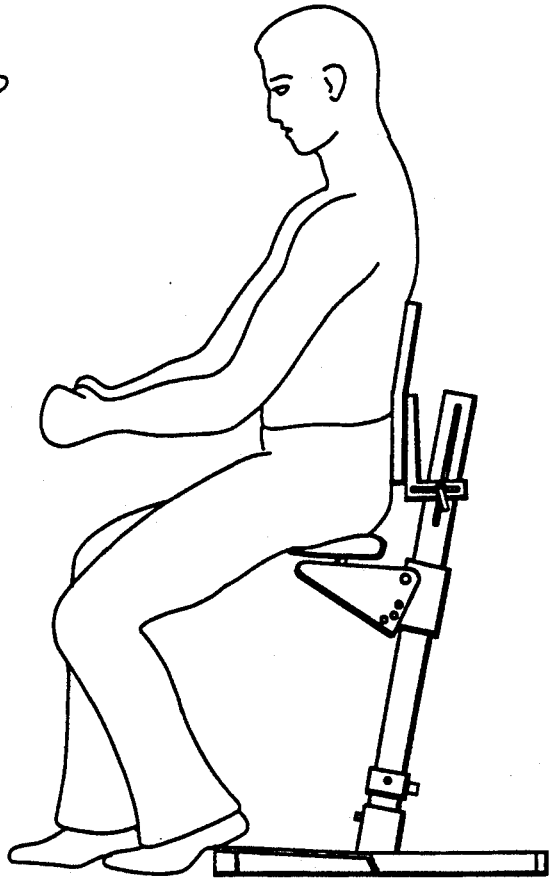
FIG. 5 shows the device of the present invention as it would be employed by a sitting user in an orientation opposite to that of FIG. 4.

FIG. 5 shows the device of the present invention as it would be employed by a sitting user in an orientation opposite to that of FIG. 4.

Figure 6:
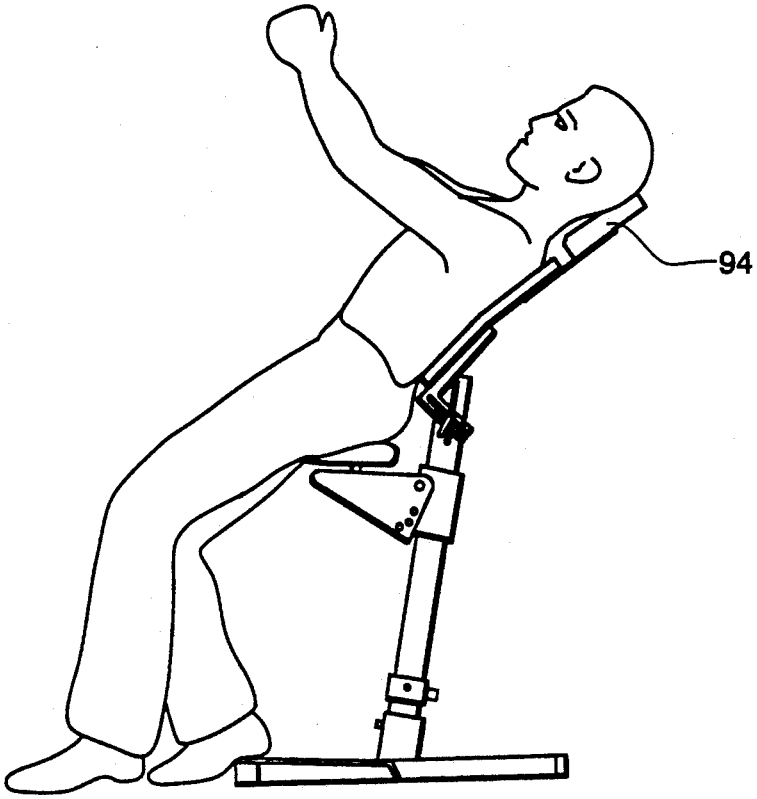
FIG. 6 shows the device of the present invention as it would be employed by a sitting user working overhead.

FIG. 6 shows the device of the present invention as it would be employed by a sitting user working overhead. Auxiliary head rest 94 may advantageously be provided to further support the user.

Figure 7:
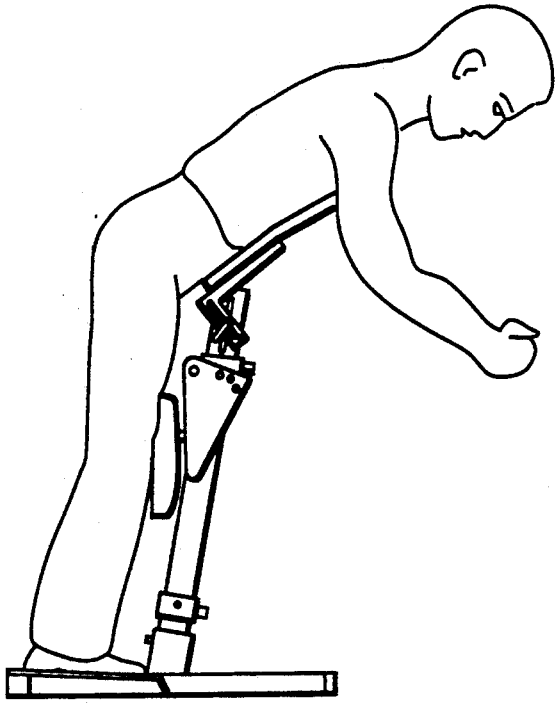
FIG. 7 shows the device of the present invention as it would be employed by a standing user leaning forward to accomplish a task.

FIG. 7 shows the device of the present invention as it would be employed by a standing user leaning forward to accomplish a task.

Figure 8:
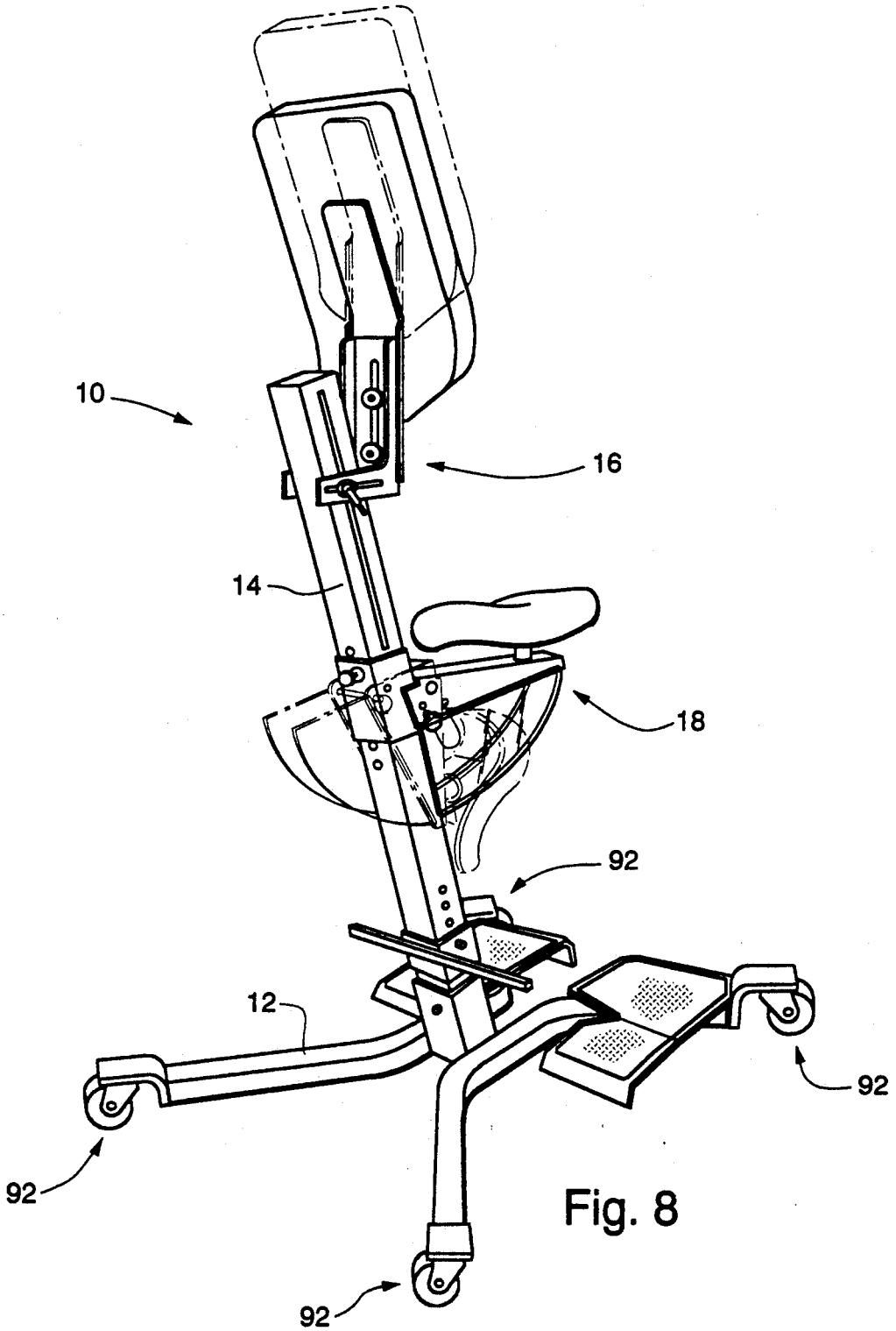
FIG. 8 shows the preferred embodiment of the device of the present invention provided with castors to increase the ease of mobility of the device.

FIG. 8 shows the preferred embodiment of the device of the present invention provided with castors to increase the ease of mobility of the device. Castors 92 at suitable positions on base 12 to enable the work stand 10 to be moved about more freely.

The structural materials employed advantageously in the present invention are fashioned from extruded or cast aluminum, although several suitable alternatives are available, as one skilled in the art would recognize readily. Likewise, the padding, where padding is desirable, is preferably some kind of foamed elastomer, and foam rubber has been used to advantage, though other suitable materials exist. Other hardware, brackets, locking pins and supports may be fashioned from aluminum or other suitable material.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What I claim is:

1. An ergonomic, multi-position work stand facilitating a user in performing work in a variety of work positions, including:

standing, leaning forward;
standing, leaning backward;
standing, working overhead;
standing, bending forward;
sitting, leaning forward;
sitting, leaning backward;
sitting, working overhead;
kneeling, leaning forward;

said work stand comprising:

a base member providing support and stability for a user and dissipating the forces placed on said work stand by a user;

at least one vertical support member securely attaching to said base member and transferring the forces placed on said work stand by a user;

an upper body support member adjustably attached to said at least one vertical support member and comprising a padded support provided with means to adjust said padded support in vertical height, horizontal placement and radial tilt with respect to said support member for the comfort and convenience of a user, said upper body support member receiving the forces placed on said work stand by a user and transferring said forces through said at least one vertical support member to said base member, said upper body support member further comprising means to position said upper body support to accommodate the chest of a user working in a forward position, or the back of a user working in a position which requires said worker to lean back; and a seat member means supporting at least a portion of the weight of a user, said seat member means adjustably mounted along the height of said at least one vertical support member to provide for height adjustment to said seating member means, and reversible in orientation with respect to said vertical support member, said seat member means further comprising means to position said seat member means to accommodate a sitting user working in a forward or rearward direction, to accommodate the knees of a kneeling worker or the calves of a standing worker, or to move to a position out of the way of a standing worker.

2. The work stand of claim 1 wherein said base member further comprises means to fixedly attach to the floor of the work space.

3. The work stand of claim 1 wherein said base member is not intended for attachment to the floor of the work space and said work stand may be freely moved and positioned within a work space.

4. The work stand of claim 3 wherein said base member has a sufficient horizontal dimension to provide support and stability and dissipate the forces placed on the work stand by a user.

5. The work stand of claim 3 wherein said horizontal dimension is provided by horizontal load-bearing members attached to said base member.

6. The work stand of claim 5 wherein said load-bearing members are removably attached for storage or shipment of the work stand.

7. The work stand of claim 3 wherein the base member further includes footpads for the placement of the feet of a user.

8. The work stand of claim 1 wherein said at least one vertical support member comprises a tubular vertical column to which the upper body support member may be attached.

9. The work stand of claim 8 wherein said tubular column is further provided with a extended, slit-like opening therethrough.

10. The work stand of claim 9 wherein the upper body support member is further provided with bolting means employed to attach said upper body support member to said tubular column by the selective positioning of said bolting means through said slit-like opening.

11. The work stand of claim 9 wherein said bolding means is further provided with radial locking means to permit the radial positioning of said upper body support member.

12. The work stand of claim 1 wherein aid seat member means is removably engaged to allow a user to employ the work stand in a standing position.

13. The work stand of claim 1 wherein the seat member means further includes means to position said seat member means to provide support for the legs of a standing user.

* * * * *